United States Patent [19]

Muranaka et al.

[11] 4,144,860

[45] Mar. 20, 1979

[54] DUAL SPARK PLUG IGNITION ENGINE

[75] Inventors: Shigeo Muranaka; Yasuo Takagi, both of Yokohama; Yasushi Araki, Tokyo; Katsuyo Kakuta, Yokohama, all of Japan

[73] Assignee: Nissan Motor Company, Limited, Yokohama, Japan

[21] Appl. No.: 787,211

[22] Filed: Apr. 13, 1977

[30] Foreign Application Priority Data

Apr. 16, 1976 [JP] Japan ..... 51-47487[U]

[51] Int. Cl.[2] ..... F02P 3/06

[52] U.S. Cl. ..... 123/148 C; 123/119 EC; 123/148 E

[58] Field of Search ..... 123/148 C, 148 DS, 117 R, 123/32 MS, 198 DC, 198 F, 119 A

[56] References Cited

U.S. PATENT DOCUMENTS

| | | | |
|---|---|---|---|
| 1,702,108 | 2/1929 | Churcher | 123/148 C |
| 1,722,145 | 7/1929 | Hermann | 123/119 A |
| 2,025,203 | 12/1935 | Harper, Jr. | 123/148 C |
| 3,554,092 | 11/1968 | Shibagaki | 123/148 C |
| 3,570,460 | 3/1971 | Demetrescu | 123/97 B |
| 3,756,205 | 9/1973 | Frost | 123/32 EA |
| 3,809,042 | 5/1974 | Hosho et al. | 123/148 C |
| 3,929,115 | 12/1975 | Yamauti et al. | 123/148 C |
| 4,040,395 | 8/1977 | Demetreseu | 123/32 EA |
| 4,068,628 | 1/1978 | Duckworth | 123/119 B |

FOREIGN PATENT DOCUMENTS

| | | | |
|---|---|---|---|
| 1481169 | 8/1974 | United Kingdom | 123/148 C |

*Primary Examiner*—Charles J. Myhre
*Assistant Examiner*—Raymond A. Nelli

[57] ABSTRACT

The air-fuel mixture in each combustion chamber of a dual spark plug ignition engine is ignited with two spark plugs during normal engine operation, but is ignited with only one of the two spark plugs during high power output engine operation. The spark timing in the ignition with one spark plug is advanced relative to that in the ignition with two spark plugs.

13 Claims, 6 Drawing Figures

DUAL SPARK PLUG IGNITION ENGINE

BACKGROUND OF THE INVENTION

This invention relates, in general, to a dual spark ignition internal combustion engine in which two spark plugs are disposed in each combustion chamber to ignite the air-fuel mixture inducted thereto, and more particularly to a spark ignition system for the above-mentioned engine.

In connection with the exhaust gas control of a spark-ignition internal combustion engine which discharges exhaust gases containing nitrogen oxides (NOx), it is difficult to decrease the emission level of NOx because the formation of NOx is increased as the combustion is improved, and NOx once generated in the combustion chamber is not easily removed by a catalytical reduction reaction, the catalyst also producing problems with respect to performance and durability. Therefore, the greatest effort is now directed to suppression of the NOx generation in the combustion chamber. Since the NOx emission control downstream of the combustion chamber encounters the above-mentioned problems, it seems easier to achieve suppression of NOx generation within the combustion chamber. For this purpose, it was proposed to supply exhaust gases into the combustion chamber in order to lower the maximum temperature of combustion carried out in the combustion chamber. This is achieved, for example, by a so-called exhaust gas recirculation system (EGR system) which is known as disclosed, for example, in U.S. Pat. No. 3,756,210, issued Sept. 4, 1973 to Kuehl. With this supply of the exhaust gases, the emission level of NOx is found to decrease as the amount of the exhaust gases is increased. However, by supplying the combustion chamber with a considerable proportion of the exhaust gases, the combustion time of the air-fuel mixture is increased and therefore stable and smooth combustion of the air-fuel mixture in the combustion chamber fails. In view of the above, the amount of the exhaust gases supplied to the combustion chamber is restricted to a relatively low level in due consideration of both stable combustion and NOx generation control. The unstable combustion of the air-fuel mixture causes deterioration of engine power output and fuel consumption characteristics.

Therefore, an attention was directed to an idea that the stable combustion in the combustion chamber is obtained by fast burn of the air-fuel mixture in the combustion chamber by shortening the combustion time of the air-fuel mixture. In this regard, a dual spark plug ignition engine in which two spark plugs are disposed in each combustion chamber has been proposed to improve the deteriorated combustion by the effect of the exhaust gases mixed with the air-fuel mixture, employing the above-mentioned idea to which the attention was directed.

Furthermore, the dual spark plug ignition engine is required to be further improved from the both viewpoints of engine noise and engine durability.

SUMMARY OF THE INVENTION

It is the prime object of the present invention to provide a dual spark plug ignition internal combustion engine which is improved in engine noise and engine durability.

Another object of the present invention is to provide an improved dual spark ignition internal combustion engine in which an excessive pressure rise during combustion in an engine cylinder is prevented under high power output engine operating condition.

A further object of the present invention is to provide an improved dual spark ignition internal combustion engine in which an ignition manner with two spark plugs per one cylinder is changed into another ignition manner with one of the two spark plugs under the high power output engine operating condition.

A still further object of the present invention is to provide an improved dual spark plug ignition internal combustion engine in which the engine power output is prevented from an abrupt change or lowering immediately after the ignition manner with two spark plugs is changed into another ignition manner with one spark plug.

A still further object of the present invention is to provide an improved dual spark plug ignition internal combustion engine in which the spark timing in an ignition manner with one spark plugs is scheduled to be advanced relative to that in another ignition manner with two spark plugs.

Other objects, features and advantages of the engine according to the present invention will become more apparent from the following description of the preferred embodiments thereof taken in conjunction with the accompanying drawings.

DESCRIPTION OF THE PREFERRED EMBODIMENTS

Figure 1:
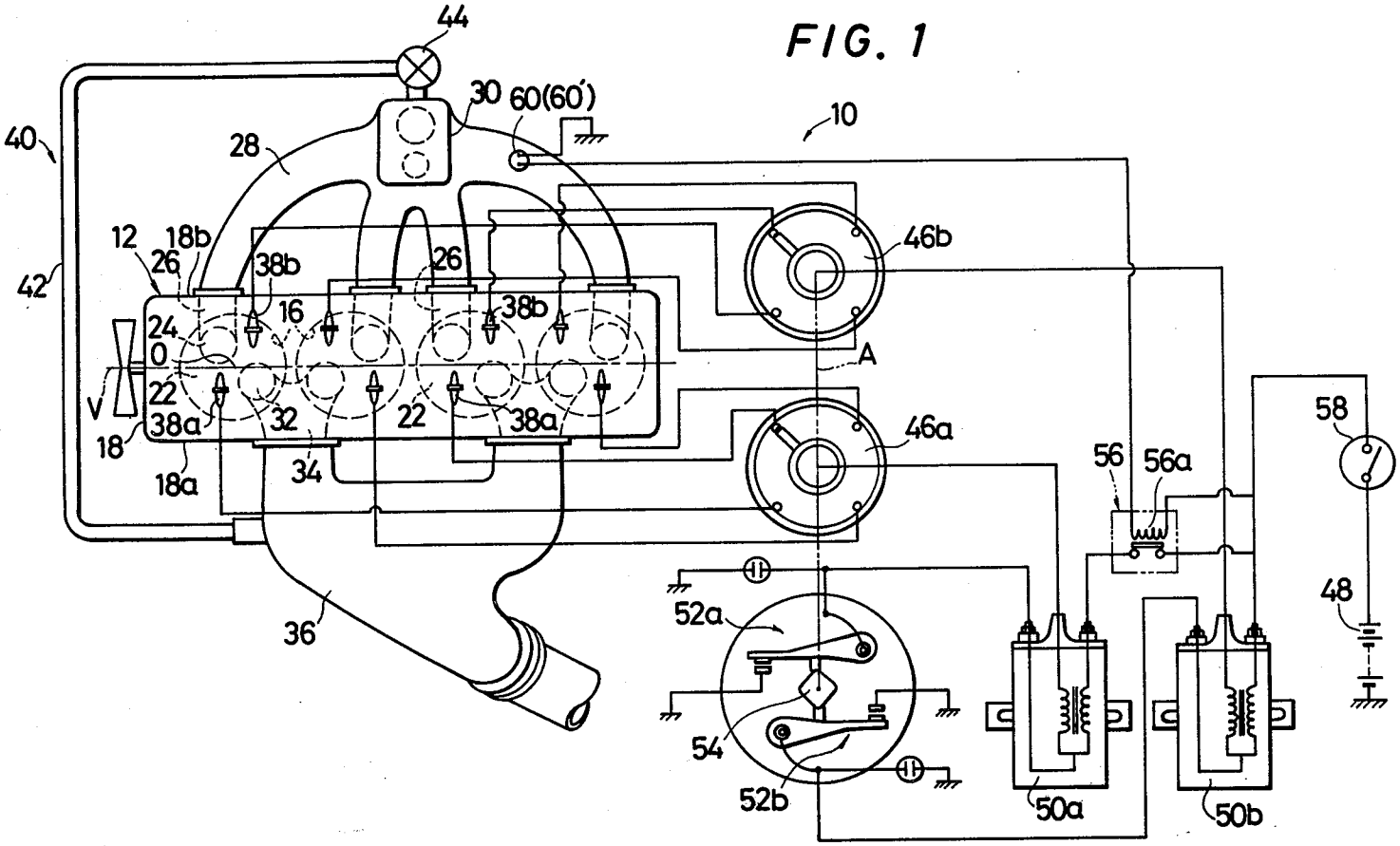
FIG. 1 is a schematic illustration of a preferred embodiment of an internal combustion engine in accordance with the present invention, showing an example of ignition system for spark plugs of the engine.
Figure 2:
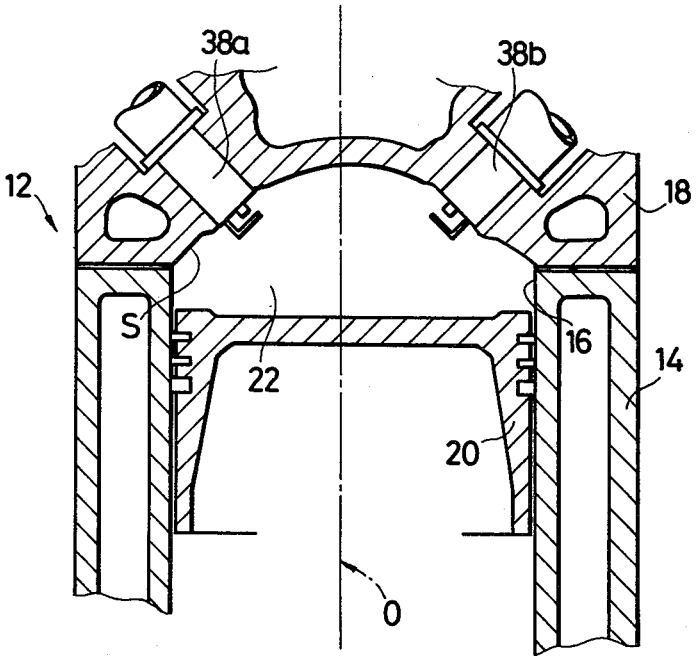
FIG. 2 is a vertical section view showing a combustion chamber of the engine of FIG. 1.

Referring now to FIGS. 1 and 2 of the drawings, a preferred embodiment of an internal combustion engine 10 in accordance with the principle of the present invention is shown as including an engine proper 12 thereof. The engine proper 12 is composed of a cylinder block 14 in which four engine cylinders 16 are formed as shown. Secured to the top portion of the cylinder block 14 is a cylinder head 18 which is formed with a convavity of which surface S closes one end of the cylinder 16. A piston 20 is disposed riciprocally movable within the cylinder 16. A combustion chamber 22 is defined by the cylindrical inner wall surface of the cylinder 16, the concavity surface S of the cylinder head 18, and the crown of the piston 20.

Each combustion chamber 22 is communicable through an intake valve head 24 to an intake port 26 which, in turn, communicates through an intake manifold 28 or an intake passage with a carburetor 30. The combustion chamber 22 is further communicable through an exhaust valve head 32 with an exhaust port 34. The exhaust port 34 is shared by adjacent two cylinders 16 and accordingly is referred to as a so-called siamesed exhaust port. The exhaust port 34 is communicated with an exhaust manifold 36 which serves as a thermal reactor for thermally oxidizing the unburned constituents contained in the exhaust gases discharged from the combustion chamber 22. As seen, the cylinder head 18 of this case employs a cross-flow induction-exhaust arrangement in which the exhaust port 34 opens to one side surface 18*a* thereof and the intake port 26 opens to an opposite side surface 18*b* thereof.

In each combustion chamber 22, a first spark plug 38*a* and a second spark plug 38*b* are disposed being secured to the cylinder head 18 so that the electrodes (no numerals) thereof project and lie in the combustion chamber 22. The first spark plug 38*a* is located such that its electrodes lie at the same side as the cylinder head side surface 18*a* with respect to an imaginary longitudinal vertical plane V which extends parallelly with the longitudinal axis (not shown) of the cylinder head 18 and passes through the center axis O of the cylinder bore or center axes of the cylinder bores as clearly shown in the Figure. On the contrary, the second spark plug 38*b* is located at the same side as the cylinder head side surface 18*b*. Hence, the first and second spark plugs 18*a* and 18*b* are located opposite with respect to the longitudinal vertical plane V.

The reference numeral 40 represents an Exhaust Gas Recirculation (EGR) system or means for recirculating a portion of the exhaust gases into the combustion chamber 22. The EGR system 40 is composed of a conduit 42 or a passageway which connects the exhaust manifold 36 forming part of an exhaust system (no numeral) and the intake manifold 28 forming part of an intake system (no numeral). Disposed in the conduit 42 is a control valve 44 which is arranged to control the amount of the exhaust gases recirculated from the exhaust system into the combustion chamber with respect to the amount of the intake air inducted through the intake system into the combustion chamber 22 in response, for example, to the venturi vacuum which is a function of the amount of the intake air. In this case, the control valve 44 is arranged to control the exhaust gases recirculated into the combustion chamber within a range up to 50% by volume of the intake air. This volume rate of recirculated exhaust gases is referred to as "EGR rate". In general, the maximum EGR rate is encountered at the acceleration during normal engine operation.

Each first spark plug 38*a* is electrically connected to a corresponding terminal of a first distributor 46*a* which functions, as usual, to distribute high tension current supplied thereto to the first spark plugs 38*a* disposed in respective combustion chambers 22. The high tension current is supplied from a first transforming device (no numeral) or first tranforming means for transforming the electric current from an electric source such as a battery 48 into high tension current. The first transforming device is composed of a first ignition coil 50*a* electrically connected to the first distributor 46*a*. The first ignition coil 50*a* is, as customary, further electrically connected to a first contact breaker 52*a* which is driven by means of a revolving cam 54.

Similarly, each second spark plug 38*b* is electrically connected to a corresponding terminal of a second distributor 46*b* which is, in turn, electrically connected to a second ignition coil 50*b* forming part of a second transforming device (no numeral) or second transforming means for transforming the electric current from the battery 48 into high tension current. The second ignition coil 50*b* is electrically connected to a second contact breaker 52*b* which is driven by means of the revolving cam 54. It will be understood that the rotors (no numerals) of the first and second distributors and the revolving cam 54 are arranged on the same axis A and therefore the rotors of the first and second distributors 46*a*, 46*b* rotate with the revolving cam 54.

The first ignition coil 50*a* is electrically connectable to the battery 48 through a normally closed electromagnetic relay switch 56 and an ignition switch 58. The second ignition coil 50*b* is electrically connected through the ignition switch 58 to the battery 48. The electromagnetic coil 56*a* of the relay switch 56 is electrically connected to ignition switch 58 and connected in series with sensing means 60 for sensing an engine operation within a high power output engine operating range in which the engine generates a high power output. It will be understood that the high power output engine operating range corresponds to an engine operating condition in which effective combustion is achieved in each combustion chamber even by ignition with only the second spark plug 38*b*. The electromagnetic relay switch 56 is arranged to establish the electrical connection between the ignition switch 58 and the first ignition coil 50*a* when its electromagnetic coil 56*a* is de-energized, and to interrupt the electrical connection therebetween when its electromagnetic coil 56*a* is energized.

In this case, the sensing means 60 is a vacuum operated switch 60′ which is disposed to communicate with the intake manifold 28 and arranged to energize the electromagnetic coil 56*a* of the relay switch 56 when the vacuum in the intake manifold is lower than a predetermined level such as a vacuum of 80 mmHg. It will be understood that the intake vacuum lower than the predetermined level represent the engine operation within the range in which the engine generates a high power output.

Figure 3:
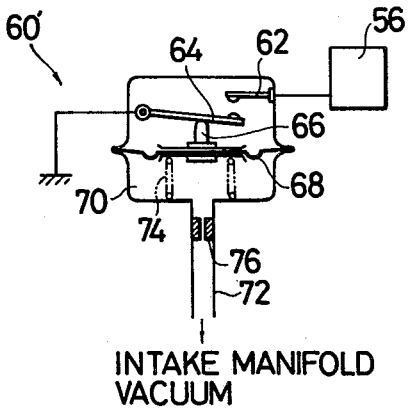
FIG. 3 is a schematic representation of a vacuum operated switch used in the engine of FIG. 1.

FIG. 3 shows in detail the vacuum operated switch 60′ which is composed of a stationary contact 62 electrically connected to the solenoid coil 56*a* of the relay switch 56 and an earthed movable contact 64. The movable contact 64 is arranged to contact the stationary contact 62 when urged in an upward direction in the drawing by a push-rod 66. The push-rod 66 is secured to a diaphragm member 68 which defines a vacuum chamber 70. The vacuum chamber 70 communicates with the inside of the intake manifold 28 through a vacuum passage 72. A spring member 74 is disposed in the vacuum chamber 70 to urge the diaphragm member 68 in the upward direction in the drawing so that the push-rod 66 causes the movable contact 64 to contact the stationary contact 62. With the arrangement of this vacuum operated switch 60′, when the intake manifold vacuum becomes lower than the predetermined level or 80 mmHg, the spring member 74 pushes up the diaphragm member 68 against the vacuum transmitted from the intake manifold 28, causing the movable contact 64 to contact the stationary contact 62 so as to close the switch 60′. The reference numeral 76 represents a flow restrictor of the form of an orifice, formed in the vacuum passage 72 through which orifice the intake manifold vacuum is supplied to the vacuum chamber 70. Accordingly, it will be appreciated that, by the effect of the flow restrictor 76, the vacuum operated switch 60′ is prevented from undesirable closing caused by fluctuation of the diaphragm member 68 due to the pulsation of the intake manifold vacuum. Because, the flow restrictor 76 functions to weaken the pulsation of the intake manifold vacuum.

The operation of the engine 10 according to the present invention illustrated in FIGS. 1, 2, and 3 will now be explained.

At normal engine operating range, the intake manifold vacuum is relatively high, i.e., higher than a vacuum level of 80 mmHg and accordingly the vacuum operated switch 60' is open since the movable contact 64 thereof does not contact the stationary contact 62 thereof. In this state, the electromagnetic relay switch 56 is closed to establish the electrical connection between the first ignition coil 50*a* and the battery 48. Of course, the electrical connection is maintained between the second ignition coil 50*b* and the battery 48. The high tension currents generated by the first and second ignition coils 50*a*, 50*b* are transmitted through the first and second distributors 46*a*, 46*b* to the four first spark plugs 38*a* and the four second spark plugs 38*b*, respectively. Then, the spark plugs 38*a* and 38*b* ignite the air-fuel mixture inducted through the intake port 26 into the combustion chamber 22. It is to be noted that the engine of this case is constructed to substantially simultaneously supply the high tension current to the first and second spark plugs 38*a* and 38*b*, and therefore the first and second spark plugs are arranged to substantially simultaneously produce sparks to ignite the air-fuel mixture.

Hence, stable combustion in the combustion chamber is obtained even through a considerably large proportion of the exhaust gases is recirculated into the combustion chamber 22 by the exhaust gas recirculation system 40, causing remarkedly lowering of the emission level of nitrogen oxides (NOx) without degradation of the engine stability and driveability.

On the contrary, at high power output engine operating range, the intake manifold vacuum is relatively low, for example, lower than a vacuum level of 80 mmHg and accordingly the vacuum operated switch is closed since the movable contact 64 is allowed to contact the stationary contact 62. In this state, the solenoid coil 56*a* of the relay switch 56 is energized to allow the relay switch 56 to open, causing the interruption of the electrical connection between the battery 48 and the first ignition coil 50*a*. As a result, provision of the high tension current to the four first spark plugs 38*a* is stopped and therefore the air-fuel mixture in each combustion chamber 22 is ignited with only second spark plug 38*b*. This prevents undesirable phenomena, occured by ignition with two spark plugs during the high power output engine operation, for example, induced unusual engine vibration, increased engine noise, and increased NOx emission level.

These undesirable phenomena result from excessively high combustion pressure generated during combustion of the air-fuel mixture in the cylinder. The high pressure is generated by fast burn (or burning within a remarkedly shortened time) of an air-fuel mixture having an improved characteristic. The fast burn is achieved by ignition with two spark plugs disposed in the combustion chamber. This improved characteristic of the air-fuel mixture is obtained, in general, by the following facts encountered during high power output engine operation: the exhaust gases recirculated into the combustion chamber through the EGR system 40 is maintained extremely small in amount or is completely stopped in consideration of power output, fuel consumption and protection of the EGR system 40 from thermal damage due to the high temperature exhaust gases; the air-fuel ratio of the mixture supplied to the combustion chamber 22 is maintained at a level slightly richer than stoichiometric to generate high power output; the volumetric efficiency of the inducted air-fuel mixture is higher since the throttle valve of the carburetor is fully or largely opened; and strong swirl turbulence is generated in the combustion chamber causing sufficient mixing of fuel and air.

In view of the above, it will be understood that, by changing dual spark plug ignition in which first and second spark plugs 38*a* and 38*b* are used into one or single spark plug ignition in which only second spark plug 38*b* is used, the occurrence of the above-mentioned undesirable phenomena are effectively prevented because the combustion time by the one spark plug ignition is prolonged or the combustion speed by the same ignition is retarded, as compared with those by the dual spark plug ignition. Therefore, the combustion pressure in the cylinder by the one spark plug ignition is not so rapidly increased as compared with that by the dual spark plug ignition.

Figure 4:
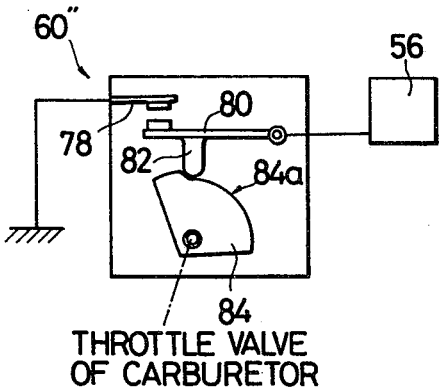
FIG. 4 is a schematic representation of a throttle operated switch used in the engine of FIG. 1.

FIG. 4 shows a throttle operated switch 60'' used as sensing means 60 for sensing an engine operation within the high power output engine operating range and accordingly the switch 60'' is replaceable with the above-mentioned vacuum operated switch 60'. This throttle operated switch 60'' is composed of an earthed stationary contact 78 and a movable contact 80 which is electrically connectable to the electromagnetic coil 56*a* of the electromagnetic relay switch 56. The movable contact 80 is provided with a projection 82 which slidably contacts the contoured cam surface 84*a* of a cam 84. Consequently, the projection 82 serves as a cam follower. The cam 84 is operatively connected to the throttle shaft on which a throttle valve (not shown) of the carburetor 30 is fixed and therefore the cam 84 rotates with the throttle shaft of the carburetor 30. The throttle valve may be that used in an engine equipped with a fuel injection system in which the carburetor is not used. The contoured cam surface 84*a* is arranged to push the projection 82 to cause the movable contact 80 to contact the stationary contact 78 in order to energize the electromagnetic coil 56*a* of the relay switch 56 when the opening degree of carburetor throttle valve becomes larger than a predetermined angle of 40 degrees. It will be understood that the throttle valve opening degree larger than 40 degrees represents an engine operation within the high power output engine operation range in which the engine generates high power output.

While only the vacuum switch 60' and the throttle operated switch 60'' have been shown and described as examples of the sensing means 60, it will be understood that the switch 60' or 60'' may be replaceable with an acceleration sensing switch for actuating the relay switch 56 in response to the acceleration of the vehicle on which the engine is mounted, or with a venturi vacuum sensing switch for actuating the relay switch 56 in response to venturi vacuum generated in the venturi portion of the carburetor 30.

Additionally, each of the above-mentioned various switches for actuating the relay switch 56 may be used in combination with an engine speed sensing switch for actuating the relay switch 56 in response to engine speeds or with a vehicle cruising speed sensing switch for actuating the relay switch 56 in response to the vehicle cruising speed, in which the engine speed sensing switch or the vehicle cruising speed sensing switch is electrically connected in parallel with each of the above-mentioned various switches. With this arrangement, in order to improve fuel consumption or fuel economy during the EGR rate is relatively low, the dual spark plug ignition may be changed into the one spark plug ignition under a high vehicle cruising speed such as during a suburban cruising at a high speed over 70 Km/hr or under a high engine speed condition such as during a high speed engine running over 2,500 rpm. In other words, the dual spark plug ignition is changed into the one spark plug ignition under high engine speed and high engine load operating conditions. It will be understood that the vehicle cruising speed over 70 Km/hr or the engine speed over 2,500 rpm represents an engine operation within the high power output engine operating range.

Figure 5:
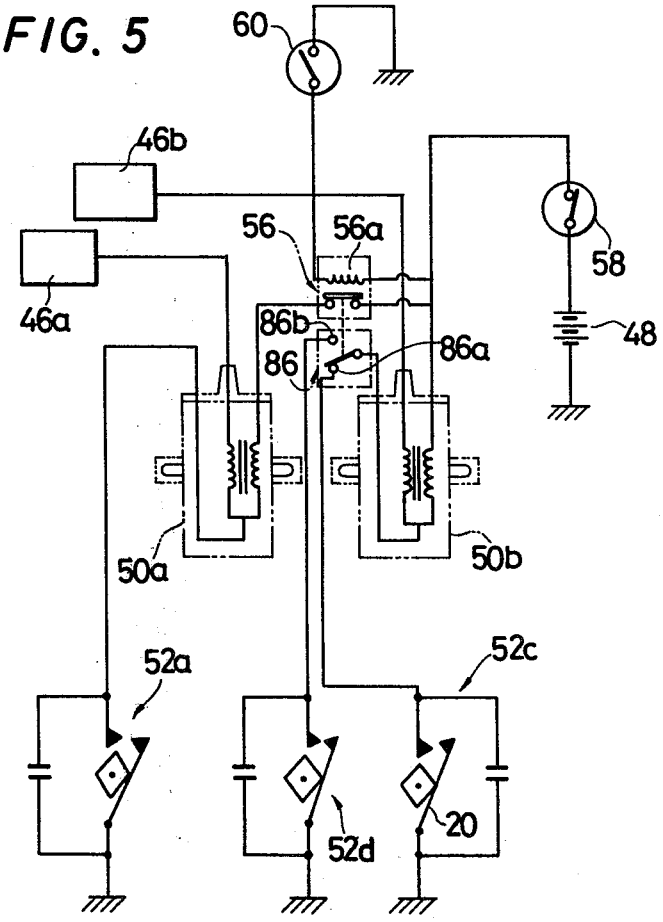
FIG. 5 is a schematic circuit diagram showing a part of another example of ignition system used in the engine of FIG. 1.

FIG. 5 shows another example of the second transforming device (no numeral) of the engine in accordance with the present invention. This second transforming device is composed of the second ignition coil 50*b* which is connected between the ignition switch 58 and the second distributor 46*b*. The second ignition coil 50*b* is electrically connected to a change-over type relay switch 86 which is, in turn, operatively connected to the electromagnetic relay switch 56. The relay switch 86 has first and second contact points 86*a* and 86*b*. The first contact point 86*a* is electrically connected to a third contact breaker 52*c* by which ignition characteristic is suitable for ignition with said first and second spark plugs 38*a* and 38*b*, whereas the second contact point 86*b* is electrically connected to a fourth contact breaker 52*d* by which ignition characteristic is suitable for ignition only with the second spark plug 38*b* in which characteristic the spark timing is advanced relative to that in the ignition characteristic of the third contact breaker 52*c*. In other words, the spark timing depending on the fourth contact breaker 52*d* is, at the same engine speed and same engine load, advanced relative to that depending on the third contact breaker 52*c*. In this case, the ignition characteristic of the third contact breaker 52*c* is set similarly to that of the first contact breaker 52*a*. The change-over type relay switch 86 is arranged to establish the electrical connection between the second ignition coil 50*b* and the third contact breaker 52*c* when the electromagnetic coil 56*a* of the relay switch 56 is de-energized, whereas to establish the electrical connection between the second ignition coil 50*b* and the fourth contact breaker 52*d* when the electromagnetic coil 56*a* of the relay switch 56 is energized.

With the thus arranged second transforming device, when the dual spark plug ignition is carried during normal engine operation, the ignition coil 50*b* is electrically connected to the third contact breaker 52*c* and accordingly the first and second spark plugs 38*a* and 38*b* ignite in the ignition characteristic suitable for the dual spark plug ignition. Conversely, when the electromagnetic coil 56*a* of the relay switch 56 is energized by the effect of the sensing means such as the vacuum operated switch 60', and the dual spark plug ignition is changed into the one spark plug ignition, the electrical connection between the ignition coil 50*b* and the fourth contact breaker 52*d* is established. Then, the ignition timing of the second spark plug 38*b* is advanced relative to that in the dual spark plug ignition. As a result, the engine power output is prevented from an abrupt change or lowering due to the occurrence of combustion retardation, in the combustion chamber, caused immediately after the dual spark plug ignition is changed into the one spark plug ignition. It is to be noted that the ignition timing characteristic suitable for the dual spark plug ignition is retarded relative to that suitable for the one spark plug ignition.

Figure 6:
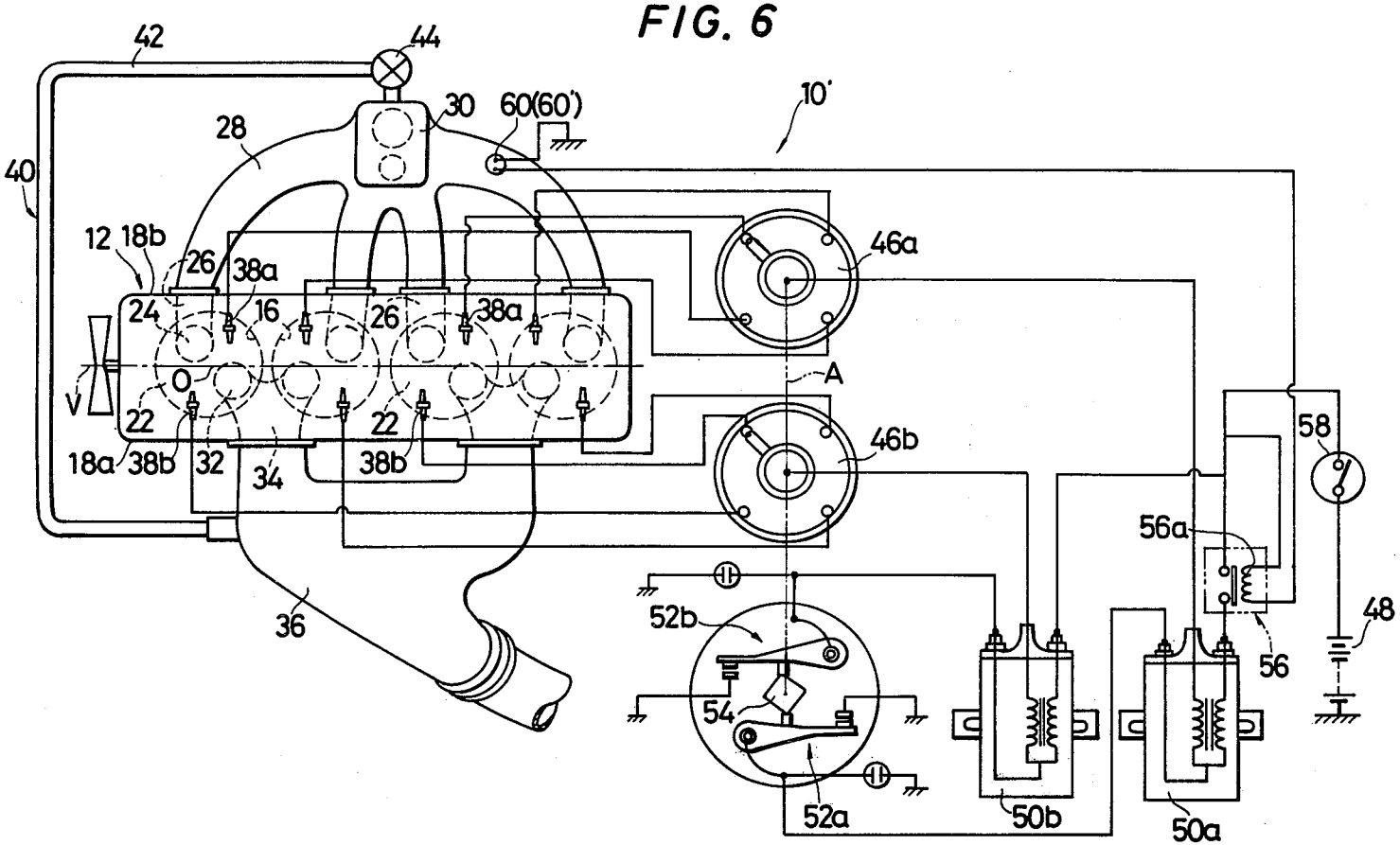
FIG. 6 is a schematic illustration of another preferred embodiment of the engine in accordance with the present invention.

FIG. 6 illustrates another preferred embodiment of the engine 10' in accordance with the present invention, which is similar to the engine 10 shown in FIG. 1 except for the location of the first and second spark plugs 38*a* and 38*b* in the combustion chamber 22. In FIG. 6, the same reference numerals as in FIG. 1 represent the same parts and elements.

In this case, the first spark plug 38*a* is located such that its electrodes lie at the same side as the cylinder head side surface 18*b* with respect to the longitudinal vertical plane V to which surface 18*b* the intake port 26 opens, and lie adjacent the intake valve head 24. Furthermore, the first and second spark plugs 38*a* and 38*b* are located so that the midpoints (not identified) of the spark gaps of the spark plugs 38*a* and 38*b* lie substantially symmetrical with respect to the cylinder center axis O, as viewed from the direction of the cylinder axis O or in plan view of the cylinder shown in FIG. 6. The spark gap of each spark plug is, as usual defined between the electrodes thereof. It will be appreciated that the electrodes of the first spark plug 38*a* is prevented from excessive cooling due to the direct striking thereagainst of incoming cool gas or new airfuel mixture inducted through the intake port 26 into the combustion chamber 22. On the contrary, the second spark plug 38*b* is located such that its electrodes lie at the same side as the cylinder side surface 18*a* with respect to the longitudinal vertical plane V to which surface 18*a* the exhaust port 34 opens.

Therefore, it will be understood that, with the above-described spark plug location, the first spark plug 38*a* is not subjected to the cooling effect of the new air-fuel mixture and therefore the first spark plug 38*a* can effectively operate even when the high tension current is again supplied thereto after supply of the current has been stopped. Furthermore, the second spark plug 38*b* is always operated during engine operation and accordingly the second spark plug is prevented from excessive cooling, contributing to prevention of carbon deposit formation on the surface of the electrodes of the spark plug.

It will be appreciated that the second contact breaker 52*b* may be replaced with the arrangement, shown in FIG. 5, which includes the change-over type relay switch 86, the third contact breaker 52*c* and the fourth contact breaker 52*d*, in order to advance the spark timing when the dual spark plug ignition is changed into the one spark plug ignition.

What is claimed is:

1. An internal combustion engine, comprising:

means defining a combustion chamber between a cylinder head and the crown of a piston reciprocally movably disposed in an engine cylinder;

first and second spark plugs disposed in the combustion chamber so that both said spark plugs function substantially the same during normal engine operating range;

means for recirculating a portion of exhaust gases discharged from the engine into the combustion chamber;

first transforming means for transforming an electric current from an electric source into a high tension current, electrically connected to said first spark plug;

second transforming means for transforming the electric current from the electric source into a high tension current, electrically connected to said second spark plug;

switching means for interrupting the electrical connection between said first transforming means and the electric source when actuated; and sensing means for sensing engine operation in a high power output engine operating range to actuate said switching means.

2. An internal combustion engine as claimed in claim 1, in which said combustion chamber is of a hemispherical shape; the midpoints of the spark gaps of said first and second spark plugs are located substantially symmetrical with respect to the center axis of the engine cylinder, as viewed from the direction of the cylinder center axis; said first and second spark plugs are arranged to substantially simultaneously produce sparks, respectively, to ignite an air-fuel mixture in the combustion chamber.

3. An internal combustion engine as claimed in claim 2, in which the exhaust gas recirculating means is arranged to recirculate the exhaust gases within a range up to 50% by volume of intake air supplied into the combustion chamber.

4. An internal combustion engine as claimed in claim 2, in which said first spark plug is located such that its electrodes are prevented from cooling effect due to the direct strike of a cool incoming gas thereagainst.

5. An internal combustion engine as claimed in claim 4, in which the cylinder head is formed with an intake port opened to one side surface thereof and an exhaust port opened to an opposite side surface thereof, said first spark plug being located at the same side as said one side surface of the cylinder head with respect to an imaginary longitudinal vertical plane which extends parallelly with the longitudinal axis of the cylinder head and passes through the center axis of the engine cylinder.

6. An internal combustion engine as claimed in claim 2, in which said switching means is an electromagnetic relay switch to interrupt the electrical connection when energized, in which said sensing means is arranged to energize said electromagnetic relay switch when it senses operation in the high power output engine operating range.

7. An internal combustion engine as claimed in claim 6, in which said sensing means is a vacuum operated switch disposed to communicate with an intake passage connected to the intake port, to energize said electromagnetic relay switch in response to a vacuum in the intake passage which vacuum represents an engine operation within the high power output engine operating range.

8. An internal combustion engine as claimed in claim 6, in which said sensing means is a throttle operated switch arranged to energize said electromagnetic relay switch in response to the opening degree of a throttle valve rotatably disposed upstream of said intake passage which degree represents an engine operation within the high power output engine operating range.

9. An internal combustion engine as claimed in claim 7, in which said vacuum operated switch includes:

a stationary contact electrically connected to the electromagnetic coil of said electromagnetic relay switch;

an earthed movable contact contactable to said stationary contact;

a diaphragm member defining a vacuum chamber which is communicated with the intake passage;

a push-rod secured to said diaphragm member to be contactable with said movable contact; and a spring member disposed in the vacuum chamber to urge the diaphragm member so that said push-rod causes said movable contact to contact said stationary contact when the intake passage vacuum is lower than a level of 80 mmHg.

10. An internal combustion engine as claimed in claim 8, in which said vacuum operated switch includes a vacuum passage connecting the vacuum chamber and the intake passage, and a flow-restrictor formed in said vacuum passage.

11. An internal combustion engine as claimed in claim 10, in which said throttle operated switch includes:

an earthed stationary contact;

a movable contact electrically connected to the electromagnetic coil of said electromagnetic relay and contactable to said stationary contact;

a projection secured to said movable contact, said projection serving as a cam follower; and a cam operatively connected to a throttle shaft on which the throttle valve fixedly mounted, and rotatable with the throttle shaft, said cam being formed with a contoured cam surface along which said projection slidably moves, said contoured cam surface being arranged to force said movable contact to contact through said projection to the stationary contact when the opening degree of the throttle valve is larger than an angle of 40 degrees.

12. An internal combustion engine as claimed in claim 1, in which said second transforming means includes:

an ignition coil electrically connected to the electric source;

a third contact breaker by which spark ignition characteristic is suitable for ignition with said first and second spark plugs;

fourth contact breaker by which spark ignition characteristic is suitable for ignition only with said second spark plug in which characteristic the spark timing is advanced relative to that in the ignition characteristic of said first contact breaker; and a change-over type relay switch arranged to establish the electrical connection between said ignition coil and said third contact breaker when said electromagnetic relay switch is de-energized and to establish the electrical connection between said ignition coil and said fourth contact breaker when said electromagnetic relay switch is energized.

13. An internal combustion engine, comprising:

means for defining a combustion chamber between a cylinder head and the crown of a piston reciprocally movably disposed in an engine cylinder;

first and second spark plugs disposed in the combustion chamber so that both said spark plugs function substantially the same during normal engine operating range;

means for recirculating a portion of exhaust gases back to the combustion chamber;

first high tension current generating means for generating a high tension current to supply it to said first spark plug, when operated;

second high tension current generating means for generating a high tension current to supply it to said second spark plug, when operated;

switching means for stopping the operation of said first high tension current generating means when actuated; and sensing means for sensing engine operation in a high power output engine operating range to actuate said switching means.

* * * * *